US009860637B1

(12) United States Patent
Zhao et al.

(10) Patent No.: US 9,860,637 B1
(45) Date of Patent: Jan. 2, 2018

(54) VEHICLE USE OF MICROPHONES OF USER'S SMART WEARABLES

(71) Applicant: GM GLOBAL TECHNOLOGY OPERATIONS LLC, Detroit, MI (US)

(72) Inventors: Xu Fang Zhao, Windsor (CA); Gaurav Talwar, Novi, MI (US); Md Foezur Rahman Chowdhury, Troy, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/280,213

(22) Filed: Sep. 29, 2016

(51) Int. Cl.
*H04R 3/00* (2006.01)

(52) U.S. Cl.
CPC ..... *H04R 3/005* (2013.01); *H04R 2430/03* (2013.01); *H04R 2499/13* (2013.01)

(58) Field of Classification Search
CPC . H04R 3/005; H04R 2430/03; H04R 2499/13
See application file for complete search history.

(56) References Cited

U.S. PATENT DOCUMENTS 9,008,641 B2 * 4/2015 Yang ..... H04W 4/046 455/414.1
9,332,126 B2 * 5/2016 Tadayon ..... H04W 48/02
9,338,605 B2 * 5/2016 Guba ..... H04W 4/027

* cited by examiner

*Primary Examiner* — Brenda Bernardi
(74) *Attorney, Agent, or Firm* — Lorenz & Kopf, LLP

(57) ABSTRACT

Methods and systems are provided for facilitating communication within vehicles. In accordance with one embodiment, a vehicle includes a passenger cabin, a receiver, and a processor. The receiver is configured to receive signals, within the passenger cabin, from one more electronic device microphones inside the passenger cabin. Each of the electronic device microphones comprises a microphone of an electronic device of a user inside the passenger cabin. The processor is coupled to the receiver, and is configured to at least facilitate generating one or more zones of communication using the received signals from the electronic device microphones inside the passenger cabin.

17 Claims, 2 Drawing Sheets

VEHICLE USE OF MICROPHONES OF USER'S SMART WEARABLES

TECHNICAL FIELD

The present disclosure generally relates to vehicles, and more particularly relates to methods and systems for facilitating audio communications within vehicles.

BACKGROUND

Certain vehicles today include systems by which one vehicle occupant can more easily communicate audibly with a vehicle system or a second vehicle occupant. However, it may be desired to further improve such systems.

Accordingly, it is desirable to provide techniques for facilitating audio communications within a vehicle. It is also desirable to provide methods, systems, and vehicles utilizing such techniques. Furthermore, other desirable features and characteristics of the present invention will be apparent from the subsequent detailed description and the appended claims, taken in conjunction with the accompanying drawings and the foregoing technical field and background.

SUMMARY

In accordance with an exemplary embodiment, a method is provided. The method comprises receiving signals, within a passenger cabin of a vehicle, from one or more electronic device microphones inside the passenger cabin, and generating one or more zones of communication using the received signals from the electronic device microphones inside the passenger cabin. Each of the electronic device microphones comprises a microphone of an electronic device of a user inside the passenger cabin.

In accordance with another exemplary embodiment, a system is provided. The system comprises a receiver and a processor. The receiver is configured to receive signals, within a passenger cabin of a vehicle, from one more electronic device microphones inside the passenger cabin. Each of the electronic device microphones comprises a microphone of an electronic device of a user inside the passenger cabin. The processor is coupled to the receiver. The processor is configured to at least facilitate generating one or more zones of communication using the received signals from the electronic device microphones inside the passenger cabin.

In accordance with a further exemplary embodiment, a vehicle is provided. The vehicle comprises a passenger cabin, a receiver, and a processor. The receiver is configured to receive signals, within the passenger cabin, from one more electronic device microphones inside the passenger cabin. Each of the electronic device microphones comprises a microphone of an electronic device of a user inside the passenger cabin. The processor is coupled to the receiver, and is configured to at least facilitate generating one or more zones of communication using the received signals from the electronic device microphones inside the passenger cabin.

DESCRIPTION OF THE DRAWINGS

The present disclosure will hereinafter be described in conjunction with the following drawing figures, wherein like numerals denote like elements, and wherein.

DETAILED DESCRIPTION

The following detailed description is merely exemplary in nature and is not intended to limit the disclosure or the application and uses thereof. Furthermore, there is no intention to be bound by any theory presented in the preceding background or the following detailed description.

Figure 1:
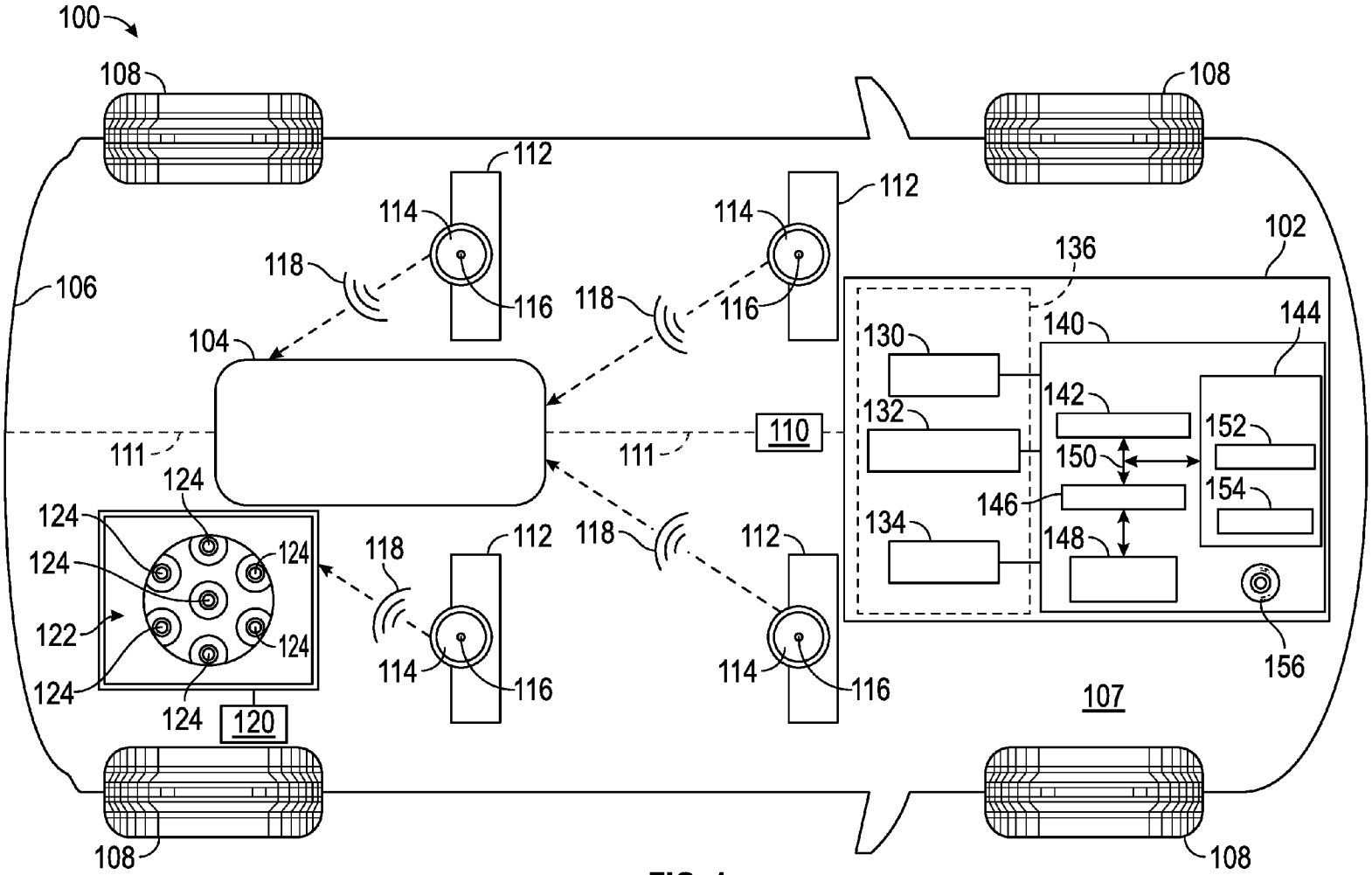
FIG. 1 is a functional block diagram of a vehicle that includes a control system for facilitating audio communications within the vehicle, utilizing microphones of electronic devices of users within a cabin of the vehicle, in accordance with an exemplary embodiment.

FIG. 1 illustrates a vehicle 100, or automobile, according to an exemplary embodiment. The vehicle 100 may be any one of a number of different types of automobiles, such as, for example, a sedan, a wagon, a truck, or a sport utility vehicle (SUV), and may be two-wheel drive (2WD) (i.e., rear-wheel drive or front-wheel drive), four-wheel drive (4WD) or all-wheel drive (AWD).

As described in greater detail further below, the vehicle 100 includes a control system 102 for facilitating audio communications within the vehicle 100. In various embodiments the control system 102 is utilized in conjunction with one or more infotainment systems 104 of the vehicle 100 (e.g. a radio, navigation system, compact disk player, DVD player, MP3 player, telephone calling system, and/or any number of other systems that provide entertainment, information, communication, and/or functionality for users of the vehicle 100). In certain embodiments, the control system 102 is part of, and/or embedded within the infotainment system 104, and/or components thereof. In other embodiments, the control system 102 is coupled to the infotainment system 104 and/or components thereof.

As depicted in FIG. 1, the vehicle 100 includes, in addition to the above-referenced control system 102 and infotainment system 104, a body 106, a passenger cabin 107 formed within the body 106, four wheels 108, and a propulsion system 110. In one embodiment, the body 106 is arranged on a chassis 111, and substantially encloses the other components of the vehicle 100. In one embodiment, the body 106 and the chassis 111 may jointly form a frame. The wheels 108 are each rotationally coupled to the chassis 111 near a respective corner of the body 106.

In various embodiments, the propulsion system 110 is mounted on the chassis 111 that drives the wheels 108. In one embodiment, the propulsion system 110 includes an engine, such as a combustion engine. In other embodiments, the propulsion system 110 may include one or more other types of engines and/or motors, such as an electric motor/generator, instead of or in addition to the combustion engine. Also in certain embodiments, the propulsion system 110 may include and/or be coupled to one or more drive shafts to drive the wheels 108.

As depicted in FIG. 1, the vehicle 100 includes various seats 112 in which occupants or users (e.g. a driver and passengers) sit within the cabin 107. Also depicted in FIG. 1 are electronic devices 116 (e.g. cellular phones, portable computers, and/or other electronic devices) of the users, each having one or more respective microphones 116. In certain embodiments, the electronic devices 114 comprise wearable electronic devices (e.g. an electronic watch, smart watch, headband, fitness band, belt, a wireless headset (e.g. Bluetooth) with a microphone, a tablet, a portable electronic device, and/or an earpiece, among various other possible wearable electronic devices) having an embedded microphone 116 within.

The control system 102 facilitates audio communications within the cabin 107 of the vehicle 100 using the microphones 116 of the users' electronic devices 114. In various embodiments, the control system 102 generates a microphone cluster 122 utilizing the microphones 116 of the users' electronic devices 114, to enhance communications within the vehicle 100. In certain embodiments, the control system 102 also utilizes any built-in microphones 120 of the vehicle 100 (e.g. by the infotainment system 104, or near a steering wheel, and/or elsewhere within the vehicle 100) as part of the cluster 122. In various embodiments, the microphone cluster 122 includes various simulated microphone nodes 124 within the cluster for facilitating communications within the cabin 107. In certain embodiments, the microphones 116 of the external, electronic devices 114 formulate an ad-hoc microphone cluster 122 that helps in creating acoustic zones within the cabin 107 of the vehicle 100. Also in one embodiment, this cluster 122 is utilized to help in establishing off axis rejection of audio that is outside the bounds of the ad-hoc acoustic zones.

The control system 102 utilizes the microphone cluster 122 to facilitate communications within the cabin 107 of the vehicle 100. In certain embodiments, the control system 102 utilizes the microphone cluster 122 to enhance communications between occupants of the vehicle 100. Also in certain embodiments, the control system 102 utilizes the microphone cluster 122 to enhance communications between one or more occupants of the vehicle 100 and one or more vehicle systems, such as one or more infotainment systems 104. In various embodiments, the infotainment systems 104 (e.g. a radio, navigation system, compact disk player, DVD player, MP3 player, telephone calling system, or the like) utilize the enhanced communications for performing functionality of the infotainment systems 104 (e.g. in making telephone calls and/or providing directions, entertainment, information, and/or other content, and/or providing any number of other services, for occupants of the vehicle 100). In various embodiments, the control system 102 and the infotainment systems 104 perform these and other functions in accordance with the steps of the process 200 of FIG. 2, described further below.

In the depicted embodiment, the control system 102 is disposed within the vehicle 100. However, this may vary in other embodiments. Also in certain embodiments, the control system 102 is mounted on the chassis 111 of the vehicle 100. However, this will also vary in other embodiments.

As depicted in FIG. 1, in one embodiment the control system 102 comprises one or more receivers 130, transmitters 132, and sensors 134, as well as a controller 140. The receiver 130 receives signals 118 from the various microphones 116 of the users' electronic devices 114. In certain embodiments, the receiver 130 also receives signals 118 from one or more built-in microphones 120. In certain embodiments, the transmitters 132 transmit signals to one or more of the microphones 116, 120, and/or to the infotainment system 104, one or more other vehicle systems, and/or to one or more servers or systems outside of the vehicle 100 (e.g. in implementing any requests for telephone calls and/or infotainment from the users of the vehicle 100). In certain embodiments, the sensors 134 identify one or more features of the microphones 116 and/or electronic devices 114, and/or a location thereof (e.g. as to whether a user is occupying a particular seat 112, and so on). In various embodiments, such functionality of the receivers 130, transmitters 132, and/or sensors 134 may be performed by a single transceiver 136, and/or multiple transceivers 136.

The controller 140 utilizes the information and signals 118 from the receivers 130, transmitters 132, sensors 134, and/or transceivers 136 (including from the microphones 116 from the users' electronic devices 114 and any built-in microphones 120) in generating the microphone cluster 122, and in facilitating audio communications within the cabin 107 of the vehicle 100. In various embodiments, the controller 140 performs these and other functions in accordance with the steps of the process 200 described further below in connection with FIG. 2.

As depicted in FIG. 1, the controller 140 comprises a computer system. In certain embodiments, the controller 140 may also include one or more of the receivers 130, transmitters 132, sensors 134, and/or transceivers 136, and/or one or more infotainment systems 104, and/or components thereof. In addition, it will be appreciated that the controller 140 may otherwise differ from the embodiment depicted in FIG. 1. For example, the controller 140 may be coupled to or may otherwise utilize one or more remote computer systems and/or other control systems, and/or one or more other systems of the vehicle 100.

In the depicted embodiment, the computer system of the controller 140 includes a processor 142, a memory 144, an interface 146, a storage device 148, and a bus 150. The processor 142 performs the computation and control functions of the controller 140, and may comprise any type of processor or multiple processors, single integrated circuits such as a microprocessor, or any suitable number of integrated circuit devices and/or circuit boards working in cooperation to accomplish the functions of a processing unit. During operation, the processor 142 executes one or more programs 152 contained within the memory 144 and, as such, controls the general operation of the controller 140 and the computer system of the controller 140, generally in executing the processes described herein, such as the process 200 described further below in connection with FIG. 2.

The memory 144 can be any type of suitable memory. For example, the memory 144 may include various types of dynamic random access memory (DRAM) such as SDRAM, the various types of static RAM (SRAM), and the various types of non-volatile memory (PROM, EPROM, and flash). In certain examples, the memory 144 is located on and/or co-located on the same computer chip as the processor 142. In the depicted embodiment, the memory 144 stores the above-referenced program 152 along with one or more stored values 154.

The bus 150 serves to transmit programs, data, status and other information or signals between the various components of the computer system of the controller 140. The interface 146 allows communication to the computer system of the controller 140, for example from a system driver and/or another computer system, and can be implemented using any suitable method and apparatus. In one embodiment, the interface 146 obtains information from the user interface 120, is coupled to the user interface 120, and/or is part of the user interface 120. In various embodiments, the interface 146 can include one or more network interfaces to communicate with other systems or components. The interface 146 may also include one or more network interfaces to communicate with technicians, and/or one or more storage interfaces to connect to storage apparatuses, such as the storage device 148.

The storage device 148 can be any suitable type of storage apparatus, including direct access storage devices such as hard disk drives, flash systems, floppy disk drives and optical disk drives. In one exemplary embodiment, the storage device 148 comprises a program product from which memory 144 can receive a program 152 that executes one or more embodiments of one or more processes of the present disclosure, such as the steps of the process 200 (and any sub-processes thereof) described further below in connection with FIG. 2. In another exemplary embodiment, the program product may be directly stored in and/or otherwise accessed by the memory 144 and/or a disk (e.g., disk 156), such as that referenced below.

The bus 150 can be any suitable physical or logical means of connecting computer systems and components. This includes, but is not limited to, direct hard-wired connections, fiber optics, infrared and wireless bus technologies. During operation, the program 152 is stored in the memory 144 and executed by the processor 142.

It will be appreciated that while this exemplary embodiment is described in the context of a fully functioning computer system, those skilled in the art will recognize that the mechanisms of the present disclosure are capable of being distributed as a program product with one or more types of non-transitory computer-readable signal bearing media used to store the program and the instructions thereof and carry out the distribution thereof, such as a non-transitory computer readable medium bearing the program and containing computer instructions stored therein for causing a computer processor (such as the processor 142) to perform and execute the program. Such a program product may take a variety of forms, and the present disclosure applies equally regardless of the particular type of computer-readable signal bearing media used to carry out the distribution. Examples of signal bearing media include: recordable media such as floppy disks, hard drives, memory cards and optical disks, and transmission media such as digital and analog communication links. It will be appreciated that cloud-based storage and/or other techniques may also be utilized in certain embodiments. It will similarly be appreciated that the computer system of the controller 140 may also otherwise differ from the embodiment depicted in FIG. 1, for example in that the computer system of the controller 140 may be coupled to or may otherwise utilize one or more remote computer systems and/or other control systems.

While the components of the control system 102 are depicted as being part of the same system, it will be appreciated that in certain embodiments these features may comprise two or more systems. In addition, in various embodiments the control system 102 may comprise all or part of, and/or may be coupled to, various other vehicle devices and systems, such as, among others, the propulsion system 110, and/or one or more other systems of the vehicle 100.

Figure 2:
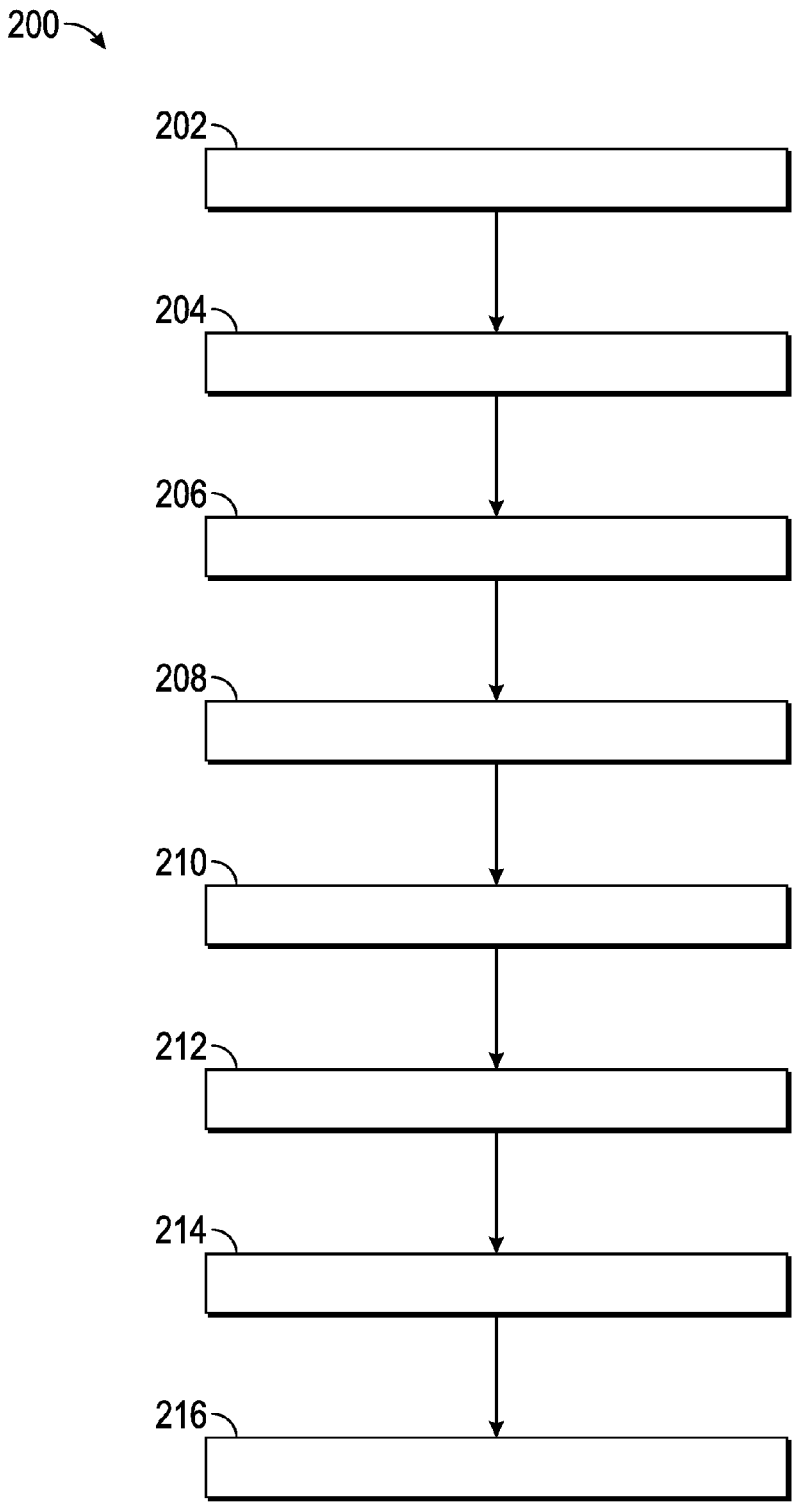
FIG. 2 is a flowchart of a process for facilitating audio communications within a vehicle, and that can be used in connection with the vehicle and the control system of FIG. 1, in accordance with an exemplary embodiment.

FIG. 2 is a flowchart of a process 200 for facilitating audio communications within a vehicle, in accordance with an exemplary embodiment. The process 200 can be implemented in connection with the vehicle 100 of FIG. 1, including the control system 102 and the infotainment system 104 of FIG. 1, in accordance with an exemplary embodiment.

As depicted in FIG. 2, the process 200 begins at step 202. In one embodiment, the process begins when a vehicle drive or ignition cycle begins, for example when a driver approaches or enters the vehicle, or when the driver turns on the vehicle and/or an ignition therefor (e.g. by turning a key, engaging a keyfob or start button, and so on). In one embodiment, the steps of the process 200 are performed continuously during operation of the vehicle.

Microphone signals are received (step 204). In various embodiments, microphone signals 118 of FIG. 1 from the microphones 116 of the electronic devices 114 (e.g. electronic wearable devices) of vehicle passengers are received via the receiver 130 and/or transceiver 136 of FIG. 1. Also in certain embodiments, microphone signals 118 from one or more built-in microphones 120 of FIG. 1 are also received via the receiver 130 and/or transceiver 136 of FIG. 1. In various embodiments, the microphone signals are received by a receiver 130 and/or 136 within the vehicle from microphones that are disposed within the passenger cabin 107 of the vehicle.

Frequency components of the microphone signals are identified (step 206). In one embodiment, frequency signals of the microphone signals received in step 204 are identified via the processor 142 of FIG. 1. In various embodiments, the frequency components are identified with respect to the microphone signals received from both the electronic device microphones 116 and the built-in microphones 120 of FIG. 1.

The various microphones are associated with one another (step 208). In one embodiment, the wireless device microphones 116 and the built-in microphones 120 of FIG. 1 are associated with one another, via the processor 142 of FIG. 1, based on the identified frequencies of step 206. In one embodiment, the microphones 116, 120 are utilized in creating one or more microphone clusters 122, for example as discussed in greater detail further below in connection with step 210.

One or more communication clusters are created (step 210). In various embodiments, the communication clusters comprise one or more microphone clusters, such as the microphone cluster 122 depicted in FIG. 1. In various embodiments, the microphone cluster 122 servers as a "virtual microphone" for communication within the cabin 107 of the vehicle 100. In certain embodiments, microphone cluster 122 is created with respect to the electronic device microphones 116 of FIG. 1 based on the received signals of step 204. In addition, in certain embodiments, the microphone cluster 122 is also created also using the built-in microphones 120 of FIG. 1. Similar to the discussion above, in various embodiments, the microphone cluster 122 includes various simulated microphone nodes 124 within the cluster for facilitating communications within the cabin 107. In addition, in various embodiments, the microphone cluster 122 is created using the frequency components of step 206 and the microphone associations of step 208. In one embodiment, the microphone cluster 122 is created by the processor 142 of FIG. 1. In one embodiment, the microphones 116 of the brought-in, external, electronic devices 114 formulate a "microphone cluster" (e.g., corresponding to cluster 122, discussed above) with built-in microphones 120 to achieve desired directivity and acoustic zoning in the vehicle cabin 107. In certain embodiments, cluster formulation shall utilize the frequency response characteristics of the built-in microphones 120 as well as the external brought-in devices' microphones 116. Directivity and acoustic zoning can be realized by means of ad-hoc or runtime adaptive beamforming patterns, and off axis audio and interfering signal and reflections rejection techniques, in various embodiments.

Zones of communication are created (step 212). In various embodiments, the zones of communication are created with respect to the electronic device microphones 116 of FIG. 1 based, directly or indirectly, on the received signals of step 204. In certain embodiments, the zones of communication are created also using the built-in microphones 120 of FIG. 1. In addition, in various embodiments, the zones of communication are created, directly or indirectly, using the frequency components of step 206 and the microphone associations of step 208. Specifically, in one embodiment, the zones of communication are created using the microphone cluster 122. Also in one embodiment, the zones of communication are created by the processor 142 of FIG. 1. In addition, similar to the discussion above, in one embodiment, the acoustic curtaining and zones can be established by means of adaptive beamforming and off-axis rejection techniques. Also in one embodiment, the ad-hoc arrangement of audio streams as established by conjunction with in-built microphones 120 provides information on un-correlated and delayed audio that can be cancelled out by means of adaptive filtering techniques. In various embodiments, these zones enable different individuals in the car to simultaneously use the voice-activated features or to have multiple independent audio interactions such as hands free phone calls, by way of example. Also in one embodiment, a potential advantage is that with acoustic zoning, each system can have independent non-interfering voice-active use cases.

Filtering is performed (step 214). In various embodiments, the filtering is performed via instructions provided by the processor 142 of FIG. 1 utilizing the communication zones 212 of step 212. In various embodiments, the filtering comprises cancelling out of echoes from signals from certain of the electronic device microphones 116 inside the passenger cabin using the zones of communication. In certain embodiments, the filtering further comprises cancelling out of echoes from signals from one or more built-in microphones 120, as appropriate. In certain embodiments, the filtering allows for improved and/or clearer communication amongst different passengers within the cabin 107 of the vehicle 100, for example by cancelling out echoes and/or other sounds from other passengers and/or associated microphones who are not presently involved in the particular conversation. Also in certain embodiments, the filtering allows for improved and/or clearer communication between a particular passenger of the vehicle 100 and the infotainment system 104 (and/or one or more other vehicle systems), for example by cancelling out echoes and/or other sounds from other passengers and/or associated microphones who are not presently involved with the communications with the infotainment system 104 (and/or other vehicle systems).

Various in-cabin communications are then implemented (step 216). In various embodiments, in-cabin communications between different passengers, and/or between certain passengers and the infotainment system 104 and/or other vehicle system, are implemented during step 216 using the filtering of step 214. For example, in certain embodiments, communications between passengers (e.g. between their respective electronic device microphones 116) are implemented by cancelling out unrelated conversations, noises, and/or echoes, and in certain embodiments by amplifying and/or facilitating transmission of sounds between the passengers' respective electronic device microphones 116, and so on. By way of further example, in certain embodiments, telephone calls may be initiated and conducted using the infotainment system 104 (and/or other communication system) using a particular passenger's communications via his or her electronic device microphones 116, and by cancelling out unrelated conversations, noises, and/or echoes, and so on. By way of additional examples, instructions and communications from a particular passenger may be communicated via his or her electronic device microphone 116 and received and implemented by the infotainment system, for example in providing content via a radio, navigation system, compact disk player, DVD player, MP3 player, and/or other system(s), and by cancelling out unrelated conversations, noises, and/or echoes, and so on. In various embodiments, step 216 is performed, at least in part, via instructions provided by the processor 142 of FIG. 1, and for example that are implemented by the infotainment system 104 of FIG. 1 and/or one or more other vehicle systems.

Applicant further notes that such an arrangement of the presently disclosed methods and systems, as set forth above, can serve several other advantages as well. For example, if the quality audio stream at a built-in microphone 120 is not optimal due to distance between the user's mouth and the microphone 120, the system can then use the microphone 116 embedded in user's external brought-in, electronic device 114, which may have better proximity to source of speech and thus better quality of input speech signal.

Another possible advantage is in the case of In Car Communications (ICC). With standard In Car Communications, there may be some delayed echo/feedback signal—due to the actual speech on top of the audio played back by the audio-speakers in the vehicle 100. This echo may otherwise cause an inconvenience to the intended recipient occupant in the vehicle. However, with the presently disclosed methods and systems as set forth above, the use of the ad-hoc microphone cluster 122 can be effective in cancelling these unintended echoes, and thereby reducing or eliminating any inconvenience to the intended recipient.

Accordingly, methods, systems, and vehicles are provided for facilitating audio communications within a cabin of a vehicle. In various embodiments, a control system utilizes microphones of passengers' electronic devices (including wearable electronic devices) to create a microphone cluster for facilitating communication within the vehicle. This can provide for potentially improved communications within the vehicle cabin, for example by filtering out unwanted sounds. In addition, this can potentially reduce costs, for example in reducing or eliminating the need for built-in microphones in certain situations.

It will be appreciated that the disclosed methods, systems, and vehicles may vary from those depicted in the Figures and described herein. For example, the vehicle 100, the control system 102, the infotainment system 104, and/or various components thereof may vary from that depicted in FIG. 1 and described in connection therewith. In addition, it will be appreciated that certain steps of the process 200 (and/or sub-processes thereof) may vary from those depicted in FIG. 2 and/or described above in connection therewith. It will similarly be appreciated that certain steps of the methods described above may occur simultaneously or in a different order than that depicted in FIG. 2 and/or described above in connection therewith.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the appended claims and the legal equivalents thereof.

What is claimed is:

1. A method comprising:

receiving signals, within a passenger cabin of a vehicle, from one or more electronic device microphones inside the passenger cabin, each of the electronic device microphones comprising a microphone of an electronic device of a user inside the passenger cabin;

identifying frequency components, based on the received signals, of each of the electronic device microphones inside the passenger cabin; and generating one or more zones of communication using the received signals from the electronic device microphones inside the passenger cabin, wherein the generating of the one or more zones of communication comprises generating the one or more zones of communication based at least in part on the identified frequency components.

2. The method of claim 1, wherein:

the step of receiving the signals comprises receiving the signals from one or more electronic device microphones inside the passenger cabin, each of the electronic device microphones comprising a microphone of a wearable electronic device of a driver or passenger inside the passenger cabin; and the step of generating the one or more zones of communication comprises generating the one or more zones of communication using the received signals from the electronic device microphones of the wearable electronic devices of the driver or passenger inside the passenger cabin.

3. The method of claim 1, further comprising:

generating one or more communication clusters using the received signals from the electronic device microphones inside the passenger cabin;

wherein the step of generating of the one or more zones of communication comprises generating the one or more zones of communication based at least in part on the communication clusters.

4. The method of claim 3, further comprising:

receiving additional signals from a built-in microphone that is installed within the vehicle; and associating the electronic device microphones inside the passenger cabin with the built-in microphone;

wherein the step of generating the one or more communication clusters comprises generating the one or more communication clusters using the received signals from the electronic device microphones inside the passenger cabin and the additional signals from the built-in microphone.

5. The method of claim 1, further comprising:

filtering the received signals based at least in part on the generated zones of communication.

6. The method of claim 5, wherein the step of filtering the received signals comprises cancelling out echoes from signals from certain of the electronic device microphones inside the passenger cabin based at least in part on the generated zones of communication.

7. A system comprising:

a receiver configured to receive signals, within a passenger cabin of a vehicle, from one or more electronic device microphones inside the passenger cabin, each of the electronic device microphones comprising a microphone of an electronic device of a user inside the passenger cabin; and a processor coupled to the receiver, the processor configured to at least facilitate:

generating one or more communication clusters using the received signals from the electronic device microphones inside the passenger cabin; and generating one or more zones of communication using the received signals from the electronic device microphones inside the passenger cabin, wherein the one or more zones of communication are generated by the processor based at least in part on the communication clusters.

8. The system of claim 7, wherein the receiver is configured to receive the signals from one or more electronic device microphones inside the passenger cabin, each of the electronic device microphones comprising a microphone of a wearable electronic device of a driver or passenger inside the passenger cabin; and the processor is configured to at least facilitate generating the one or more zones of communication using the received signals from the electronic device microphones of the wearable electronic devices of the driver or passenger inside the passenger cabin.

9. The system of claim 7, wherein the processor is further configured to at least facilitate:

identifying frequency components, based on the received signals, of each of the electronic device microphones inside the passenger cabin; and generating the one or more zones of communication based at least in part on the identified frequency components.

10. The system of claim 7, wherein:

the receiver is further configured to receive additional signals from a built-in microphone that is installed within the vehicle; and the processor is further configured to at least facilitate:

associating the electronic device microphones inside the passenger cabin with the built-in microphone; and generating the one or more communication clusters using the received signals from the electronic device microphones inside the passenger cabin and the additional signals from the built-in microphone.

11. The system of claim 7, wherein the processor is further configured to at least facilitate filtering the received signals based at least in part on the generated zones of communication.

12. The system of claim 11, wherein the processor is further configured to at least facilitate filtering the received signals by cancelling out echoes from signals from certain of the electronic device microphones inside the passenger cabin based at least in part on the generated zones of communication.

13. A vehicle comprising:

a passenger cabin;

a receiver configured to receive signals, within the passenger cabin, from one or more electronic device microphones inside the passenger cabin, each of the electronic device microphones comprising a microphone of an electronic device of a user inside the passenger cabin; and a processor coupled to the receiver, the processor configured to at least facilitate:

generating one or more zones of communication using the received signals from the electronic device microphones inside the passenger cabin; and filtering the received signals by cancelling out echoes from signals from certain of the electronic device microphones inside the passenger cabin based at least in part on the generated zones of communication.

14. The vehicle of claim 13, wherein:

the receiver is configured to receive the signals from one or more electronic device microphones inside the passenger cabin, each of the electronic device microphones comprising a microphone of a wearable electronic device of a driver or passenger inside the passenger cabin; and the processor is configured to at least facilitate generating the one or more zones of communication using the received signals from the electronic device microphones of the wearable electronic devices of the driver or passenger inside the passenger cabin.

15. The vehicle of claim 13, wherein the processor is further configured to at least facilitate:

identifying frequency components, based on the received signals, of each of the electronic device microphones inside the passenger cabin; and generating the one or more zones of communication based at least in part on the identified frequency components.

16. The vehicle of claim 13, wherein the processor is further configured to at least facilitate:

generating one or more communication clusters using the received signals from the electronic device microphones inside the passenger cabin; and generating the one or more zones of communication based at least in part on the communication clusters.

17. The vehicle of claim 16, wherein:

the receiver is further configured to receive additional signals from a built-in microphone that is installed within the vehicle; and the processor is further configured to at least facilitate:

associating the electronic device microphones inside the passenger cabin with the built-in microphone; and generating the one or more communication clusters using the received signals from the electronic device microphones inside the passenger cabin and the additional signals from the built-in microphone.

* * * * *